US005375582A

United States Patent [19]

Wimer

[11] Patent Number: 5,375,582

[45] Date of Patent: Dec. 27, 1994

[54] METHOD AND APPARATUS FOR REGULATING TEMPERATURE OF NATURAL GAS FUEL

[75] Inventor: Burnell P. Wimer, Boise, Id.

[73] Assignee: MK Rail Corporation, Boise, Id.

[21] Appl. No.: 162,442

[22] Filed: Dec. 3, 1993

[51] Int. Cl.[5] ..... F02B 43/00

[52] U.S. Cl. ..... 123/563; 123/528; 123/525

[58] Field of Search ..... 123/557, 563, 528, 525, 123/527; 60/599

[56] References Cited

U.S. PATENT DOCUMENTS

| | | | |
|---|---|---|---|
| 2,821,843 | 2/1958 | Mengelkamp et al. | 125/525 |
| 3,577,726 | 4/1971 | Wagner | 123/528 |
| 4,347,824 | 9/1982 | Pierson | 123/525 |
| 4,545,356 | 10/1985 | Casey | 123/527 |
| 4,769,995 | 9/1988 | Serve et al. | 123/528 |
| 4,864,991 | 9/1989 | Snyder et al. | 123/525 |
| 4,961,404 | 10/1990 | Itakura et al. | 123/563 |
| 5,035,206 | 7/1991 | Welch et al. | 123/525 |
| 5,081,977 | 1/1992 | Swenson | 123/527 |
| 5,105,790 | 4/1992 | Nye | 123/527 |
| 5,231,838 | 8/1993 | Cieslukowski | 123/527 |

*Primary Examiner*—Tony M. Argenbright
*Assistant Examiner*—M. Macy
*Attorney, Agent, or Firm*—Frank J. Dykas; Craig M. Korfanta

[57] ABSTRACT

A combined LNG vaporizer and engine to aftercooler coolant heat exchanger 72 is provided for use in maintaining vaporized gas fuel at a design temperature band within the charged combustion air temperature so as to automatically compensate for ambient air and fuel density variations to more accurately maintain a combustible stoichiometric mixture of vaporized LNG and combustion air during periods of engine idling or low power operation or during periods of extreme cold or extreme hot ambient air conditions.

7 Claims, 4 Drawing Sheets

METHOD AND APPARATUS FOR REGULATING TEMPERATURE OF NATURAL GAS FUEL

DESCRIPTION

BACKGROUND OF THE INVENTION

1. Technical Field

This invention generally relates to an apparatus and method for vaporizing liquid natural gas for use as an engine fuel, and more particularly to an apparatus and method for tracking vaporized fuel temperature with pressurized combustion air temperature throughout a range of ambient air temperature and operating conditions.

2. Background Art

The railroad industry, like the automotive and truck industries, is faced with the dual challenges of improving operating cost efficiency, and at the same time reducing pollutant emissions, including nitrogen oxides ($NO_x$), hydrocarbons, and carbon particulates. The challenge is aggravated by the fact that with most engine fuels, particularly diesel no. 2, these goals are almost mutually exclusive. Reducing emissions usually results in decreased operating efficiency.

Using liquified natural gas, or liquified methane, stored at cryogenic temperatures provides an attractive alternative to diesel fuel since both operating cost savings and pollutant emissions reductions can be achieved. Two particularly attractive fuels are methane, $CH_4$, and various natural gas mixtures of methane, $CH_4$, ethane $C_2H_6$, and propane $C_3H_8$.

However, there are some inherent problems, at least in the locomotive industry, with regards to utilizing liquid natural gas (LNG) as a fuel for a railroad locomotive. First, in order to carry a sufficient quantity of fuel, the methane or natural gas must be liquified and stored at cryogenic temperatures, in specially insulated pressure vessels. This fuel must then later be reheated, or vaporized, in order to be usable. Another problem is that with the use of LNG in a spark ignited otto cycle engine, although the combustible air/fuel ratio range is relatively wide, the air to fuel mass ratio required for stable operation is relatively narrow. In fact, at low engine load conditions, or at idle engine conditions, the air/fuel mixture ratio required for stable combustion is narrowly banded about the stoichiometric point. Engine manufacturers rely on sensitive engine air/fuel ratio control to meet difficult criteria, including strict emission standards.

The stoichiometric equation for the combustion of methane is represented by the balanced equation in which all of the carbon in the fuel is converted to carbon dioxide and all of the hydrogen to water. In the case of methane, the equation is $CH_4+2O_2=CO_2+2H_2O$. Since oxygen is only one component of air, a more complete stoichiometric equation for combustion of methane, in air, is $CH_4+2(O_2+3.3773N_2)=CO_2+2H_2O+6{,}546N_2$. Substituting molecular weights for oxygen, average atmospheric nitrogen, atomic carbon and atomic hydrogen, results in an air to fuel mass ratio of 13.77 moles of air to each mole of fuel. This is a mass ratio, not a volumetric ratio. Thus, to maintain stoichiometric operating conditions, the challenge is to maintain the proper air to fuel mass ratio over a wide variety of operating conditions.

There are a number of different ways of adding the vaporized LNG to the charged air. They can be broken down into two broad categories, the first being the use of a carburetor to mix vaporized LNG with the charged air prior to its introduction into the combustion chambers, and the second, a direct injection of fuel into the combustion chambers of each cylinder. Carburetors are only used with spark ignited engines. Direct injection, or fuel injection, are used both in spark ignited and diesel engines.

In a carburetor, the charged air flows through a converging, diverging nozzle called the venturi. A pressure differential is set up between the carburetor inlet and the throat of the nozzle and is used to meter the appropriate flow of vaporized LNG for the given air flow. This is a volume flow rate metering system, not a mass flow rate metering system. Various design parameters for the carburetor, throttling devices, and pressure regulating devices for the vaporized LNG can be used to adjust the volumetric metering of the carburetor such that the air to vaporized LNG ratio of the volumetric metering system matches the air to fuel mass ratio for design combustion conditions for any given engine operating range for fixed ambient air and atmospheric pressure conditions. Changes in ambient air temperature or pressure, supercharger aftercooler temperature, or changes in fuel temperature or pressure will cause the volumetric ratio of the carburetion system to diverge from the air to fuel stoichiometric mass ratio required for proper combustion for low load conditions.

Changes in atmospheric pressure are primarily altitude dependent. These changes can be compensated for by either restricting operation of a given carbureted LNG engine to a given altitude range, or by some sort of pressure regulation for controlling the supply of vaporized LNG to the carburetor. These pressure changes can be significant, for example, atmospheric pressure at 5,000 feet above sea level is approximately 17% less than atmospheric pressure at mean sea level.

Ambient temperature variations, especially winter to summer, can produce changes of comparable magnitude to altitude changes. There are numerous locations throughout North America where ambient temperature variations can vary from lows of −40° F. in winter to highs exceeding 110° F. in summer. The air density changes resulting from ambient air temperature variations are not compensated for in the volumetric metering of the carburetor in a natural gas engine. This is particularly true when the engine is lightly loaded and idling where the band width for the mass ratio of air to fuel is a narrow band near stoichiometric. In cold weather, at idling conditions, the cold, dense mass of air passing through the volumetric carburetor can increase the volumetric air to fuel ratio to where the mixture is too lean to burn. Conversely, with idling conditions and very hot ambient air, the mass of the air passing through the volumetric carburetor will be much lower, and can result in an air/fuel mixture that is too rich for combustion.

The amount of power generated in an engine of given size is, in a very basic sense, dependent upon the amount of air and fuel mixed together and therefor the amount of fuel combusted within the engine. For that reason, exhaust gas turbochargers or mechanically powered superchargers are incorporated in most of the engine configurations for locomotives. Turbochargers or superchargers compress the combustion air before it is introduced into the cylinder combustion chambers to increase output horsepower. Unfortunately, compressing the combustion air increases its temperature and results in higher $NO_x$ emissions and premature detonation in spark ignited engines. As a result, locomotives utilizing turbochargers or superchargers incorporate aftercoolers to extract some of the heat added to the charged combustion air during the compression process.

Turbochargers and superchargers add significant amounts of heat to the combustion air during the compression process. At most operating speeds and under most ambient air conditions, the turbocharging or supercharging process will add enough heat to the compressed combustion air to raise its temperature above that desired for efficient steady state operation of the natural gas engine. As a result, under most operating conditions, the compressed air must be cooled in an aftercooler to bring its temperature back down to the desired set point intake air temperature. This aftercooling of combustion air to reduce its temperature to a steady state set point will compensate for most changes in air density caused by ambient air temperatures, particularly at high power and relatively high ambient air conditions. Thus, under warm, steady state, high power operation, the volumetric air to fuel flow ratio of the carburetor can be regulated to the air to fuel ratio required for proper combustion.

Under idle or low power operating conditions, or during extreme cold ambient air conditions, the turbocharging or supercharging process may not add enough heat to bring the compressed combustion air up to the design set point temperature. It is during these conditions that the volumetric air to fuel ratio established by the carburetor may not match, or track, with the required air to fuel mass ratio.

Accordingly, it is an object of this invention to provide a method and apparatus for adjusting the density of the vaporized LNG during engine warm up, idling, low power, and extremely cold ambient air conditions, so as to more closely match the volumetric air to fuel ratio of the carburetor to the stoichiometric mass air to fuel ratio required for efficient combustion. It is another object of the present invention to maintain thermal equilibrium between the vaporized LNG and the combustion air during overall steady state, high power, and high ambient air operating conditions.

It is an object of the present invention to provide for automatically adjusting the temperature, and thus the mass density, of vaporized LNG to compensate for mass density changes in combustion air caused by changes in ambient air temperature. And finally, it is an object of this invention to utilize the combination of engine jacket water heat and aftercooler heat to best accomplish these adjustments.

DISCLOSURE OF INVENTION

These objects are achieved by the use of aftercooler coolant heat to vaporize liquid LNG in a coolant system having two separate coolant loops, an engine jacket water coolant loop and a separate aftercooler coolant loop which are interconnected for heat exchange during cold ambient air, idle or low load operating conditions.

In a first embodiment, a standard engine jacket water loop is provided with a pump, pumping a conventional coolant solution through a discharge line to an engine oil cooler and a natural gas (NG) spark ignited engine. Under normal operating conditions, engine jacket water passes from the NG engine into an engine radiator where it is cooled and then returned to the engine water pump. An engine radiator of conventional design with heat dissipation fins and a radiator fan are provided.

An aftercooler coolant loop is also provided with an aftercooler coolant pump, pumping an identical mixture of ethylene glycol and water coolant through a discharge line to an aftercooler. Heated aftercooler coolant then passes from the aftercooler through a similar, conventional aftercooler radiator which is of similar design to the engine radiator, and then back to the aftercooler coolant pump.

During engine start up or during operation at extremely cold ambient air temperatures, or operation at either idle or low power settings, the heat generated during the turbocharging process may be insufficient to bring the charged air temperature up to design operating temperature, and therefore the aftercooler coolant temperature up to the designed operating temperature. During these conditions, heated engine jacket water is diverted into an engine to aftercooler heat exchanger, where it is used to supply heat to the aftercooler coolant so as to bring or hold the temperature of the coolant and thus the temperatures of both the charged combustion air and vaporized LNG at or near the design set point temperature.

Locating the LNG vaporizer in the aftercooler circuit ensures that the temperature of the incoming charged combustion air and the vaporized LNG closely match the aftercooler coolant temperature, and thus each other. In this manner, the density changes of the vaporized LNG will track with the density changes of the incoming charged combustion air, thus more closely matching the volumetric air to fuel ratio of the carburetor to the stoichiometric mass air to fuel ratio required for efficient combustion.

In second and third embodiments, a combined vaporizer and engine to aftercooler heat exchanger is provided. In these embodiments, the same general engine jacket water and aftercooler coolant cooling loops are provided. The interconnection for operable heat exchange between the engine jacket water loop and the aftercooler coolant loop is made by use of a combined vaporizer and engine to aftercooler heat exchanger. Vaporizer coils are to disposed within a cylindrical aftercooler coolant jacket, through which the aftercooler coolant flows continuously. In the central core area of the combined vaporizer and engine to aftercooler heat exchanger, there are provided a plurality of heat exchanger tubes through which engine jacket water selectively flows.

Engine jacket water flow is supplied to the combined vaporizer and engine to aftercooler heat exchanger whenever aftercooler coolant temperature is below a predetermined setpoint. In one embodiment, the second embodiment described in this specification, this is accomplished by means of a regulator which diverts engine coolant flow from the supply to the engine jacket water pump. In the third embodiment, the jacket water heat exchanger tubes of the combined vaporizer and engine to aftercooler heat exchanger are hard plumbed to the engine jacket water coolant loop with a flow therethrough being regulated by means of a conventional thermostatic valve.

BEST MODE FOR CARRYING OUT INVENTION

Figure 1:
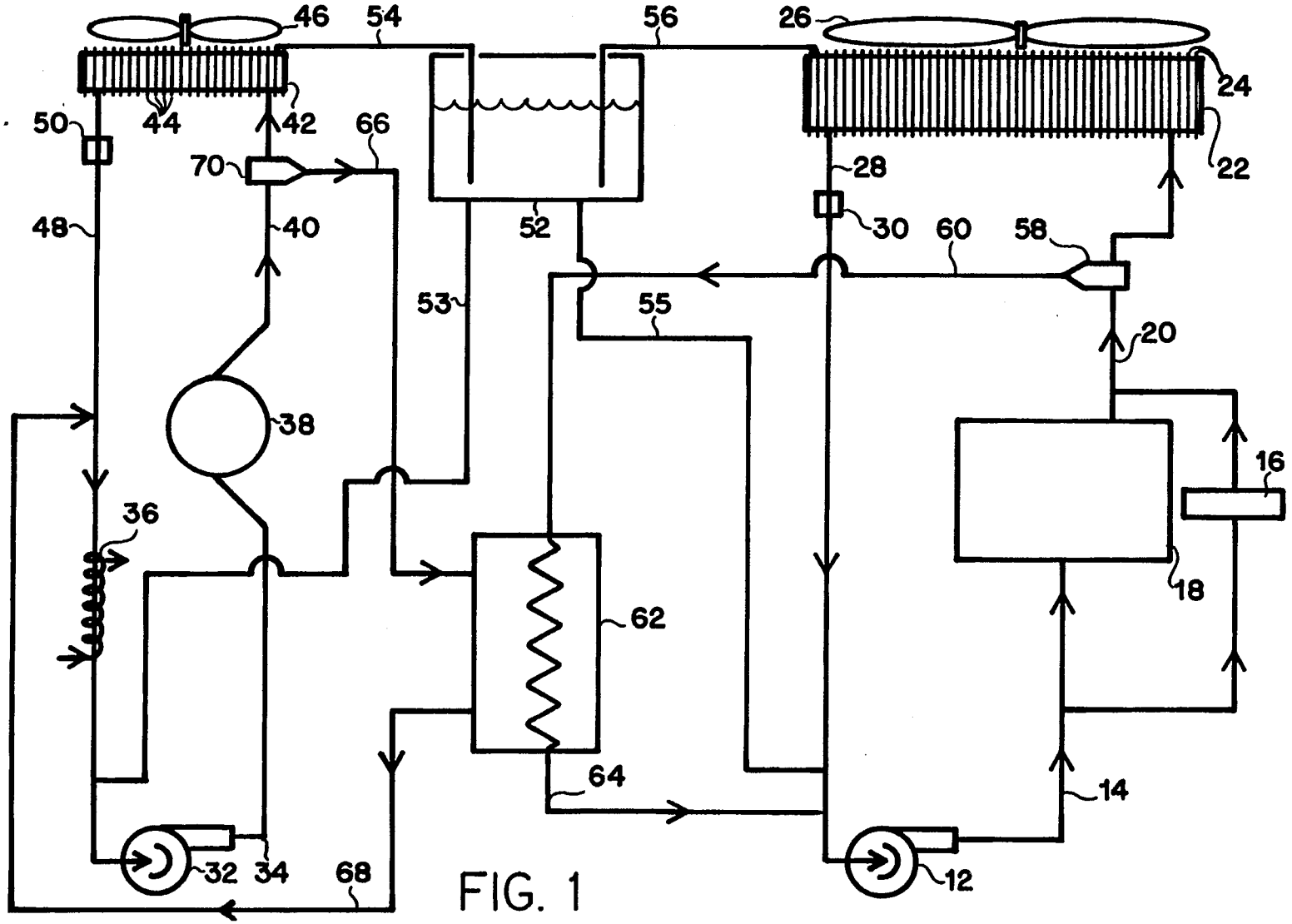
FIG. 1 is a schematic representation of a first embodiment showing an aftercooler cooling loop and an engine jacket water cooling loop interconnected by means of an engine to aftercooler heat exchanger.

FIG. 1 discloses a first embodiment of the present invention. In FIG. 1, there are two separate cooling loops, one for a spark ignited, LNG fueled engine 18, and the other for combustion air aftercooler 38.

Starting with the engine jacket water cooling loop, there is provided engine jacket water pump 12 which pumps a conventional ethylene glycol and water coolant solution, hereinafter referred to as "jacket water", through discharge line 14 to the oil cooler 16 and the LNG spark ignited engine 18. Engine jacket water exits NG spark ignited engine 18 through line 20, through regulator 58, and passes into engine jacket water radiator 22, which is also of conventional design, having heat dissipating radiator fins 24 and engine radiator fan 26. Heated jacket water from the engine is cooled in engine radiator 22, and is returned to engine jacket water pump 12 through return line 28. A conventional fan switch 30 is provided for controlling the operation of engine radiator fan 26.

The second loop is for aftercooler 38 and it begins with aftercooler coolant pump 32 which pumps a similar mixture of ethylene glycol and water coolant through discharge line 34 to aftercooler 38. Aftercooler coolant is utilized in aftercooler 38 to extract heat from the compressed combustion air generated by either a conventional turbocharger or supercharger. Aftercooler coolant exits aftercooler 38 through discharge line 40 and passes into aftercooler radiator 42, which like engine radiator 22, is of conventional design having heat dissipation fins 44 and aftercooler radiator fan 46. Cooled aftercooler coolant exits aftercooler radiator 42 through line 48 and is returned to aftercooler coolant pump 32. Fan switch 50 controls the operation of aftercooler radiator fan 46 in a conventional and well known manner. The coolant solutions used in the engine cooling loop and in the aftercooler cooling loop are identical in chemical composition, with both engine radiator 22 and aftercooler radiator 42 sharing a common radiator coolant expansion tank 52 through overflow lines 54 and 56 and coolant shunt lines 53 and 55.

In the preferred embodiment, the NG spark ignited engine 18 is configured and designed as a carbureted engine, and further designed for optimal operation with a maximum inlet compressed combustion air temperature of approximately 130° F. The engine jacket water radiator 22 has a design heat transfer capacity sufficient to maintain engine jacket water outlet temperature at 210° F. at maximum operating power at an outside ambient air temperature of 115° F.

Since engine 18 is a carbureted engine, the carburetor maintains a volumetric air to fuel ratio as opposed to a mass ratio, and as long as incoming compressed combustion air and the vaporized LNG remain at a constant temperature of 130° F., the carburetor volumetric ratio will be balanced to coincide with the air to fuel mass ratio for a stoichiometric mixture and it will remain balanced throughout the entire range of operating powers from idle to full or maximum power.

The amount of heat imparted to the incoming combustion air during the charging process is dependent upon turbocharger or supercharger rpm, which in the conventional locomotive engine design, is dependent upon engine rpm or load. At high rpm, under all but the most extremely cold ambient air conditions, there is sufficient heat generated in the compression process to meet, or exceed, the design charged air temperature. This is the reason why aftercooler 38, and its associated aftercooler coolant loop are provided. Aftercooler coolant flowing through aftercooler 38 is intended to remove the excess heat which is dissipated through two heat dissipation sources, the first being aftercooler radiator 42, and the second, LNG vaporizer 36. When aftercooler coolant flowing from radiator 42 through return line 48 reaches the set point of fan switch 50, it operates to turn on aftercooler radiator fan 46 to increase air flow across heat dissipation fins 44 to maintain the desired aftercooler coolant temperature.

Vaporizer 36 also functions as a heat sink, however under most operating conditions, especially at power, it is insufficient, in and of itself, to extract all of the excess heat from the aftercooler coolant. LNG enters vaporizer 36 at cryogenic temperatures of approximately −220° F. Its latent heat of vaporization is only 200 BTUs per pound, and its specific heat is quite low. As a result, at high engine loads, the heat sink capabilities of vaporizer 36 are usually insignificant.

Even so, there is a substantial mechanical advantage to this configuration for vaporizer 36, in that aftercooler radiator 42 has to be sized so as to dissipate excess heat from aftercooler 38 to outside ambient air under all design ambient air conditions, including temperatures of up to 115° F. This results in a relatively small temperature differential between the aftercooler coolant in aftercooler radiator 42 and outside ambient air, necessitating a rather large aftercooler radiator 42 so as to insure adequate heat dissipation surfaces. The most extreme conditions are of high ambient air temperature and high engine load, and at these conditions, the heat extracted from the aftercooler coolant in line 48 by vaporizer 36 becomes significant, and results in a significant size reduction in aftercooler radiator 42.

At low load, low engine rpm, conditions, and at lower ambient temperatures, the heat added to the incoming combustion air by the turbocharger or supercharger may be insufficient to raise its temperature to the designed set point. Under these conditions, in the first embodiment, heat from the engine jacket water being discharged from engine 18 through line 20 is used to warm the aftercooler coolant. Regulator valve 58 disposed within line 20 is used to divert some, or even all, of the engine jacket water flowing into line 20 from engine 18 into heat exchanger supply line 60 through which it flows into engine to aftercooler heat exchanger 62.

Concurrently, regulator 70, located in discharge line 40 from aftercooler 38, is used to divert flow of aftercooler coolant from a aftercooler radiator 42 into aftercooler heat exchanger bypass line 66 where it picks up heat from the engine jacket water in engine to aftercooler heat exchanger 62. The diverted engine jacket water being discharged from engine to aftercooler heat exchanger 62 is returned to return line 28 by means of heat exchanger return line 64. The now warmer aftercooler coolant discharging from engine to aftercooler heat exchanger 62 is returned to return line 48 through aftercooler heat exchanger bypass return line 68.

In the first embodiment, regulator 70 is set to divert aftercooler coolant into aftercooler to heat exchanger bypass line 66 at any time aftercooler coolant is cooler than 90° F. Regulator 58 is responsive to the diversion at any engine jacket water temperature below 190° F. Below 190° F., regulator 58 diverts all engine jacket water through engine to aftercooler heat exchanger 62. Starting at approximately 190° F., regulator 58 initiates a regulated flow of engine jacket water through engine jacket water radiator 22. As engine operating temperature further increases the temperature of the engine jacket water, regulator 58 responds by diverting more jacket water flow to radiator 22 to maintain the desired engine jacket water outlet temperature less than a maximum of 210° F.

Thus in operation, during engine and aftercooler warmup, the aftercooler coolant is not passing through aftercooler radiator 42, but rather is being diverted to engine to aftercooler heat exchanger 62. Likewise, low engine demand causes the majority of the jacket water to bypass through heat exchanger 62. In this configuration, jacket water heat maintains the aftercooler coolant at the design set point temperature even during cold ambient air conditions and/or light engine load conditions, thus again maintaining stoichiometric or other predetermined conditions necessary for the balance between the volumetric carburetor air to fuel ratios and the required stoichiometric mass ratio for efficient combustion. In addition, stoichiometric or any other predetermined conditions for the vaporized LNG and combustion air are maintained during the transient warm-up phase since the temperature of the vaporized LNG being discharged from vaporizer 36 will track with the temperature of the aftercooler coolant in discharge line 34.

In addition, since this design adds heat, whenever possible, to the aftercooler when operating in ambient air temperature or engine loads when insufficient heat is generated by the turbocharger or supercharger operation, the possibility of aftercooler icing is greatly reduced, if not entirely eliminated.

Figure 2:
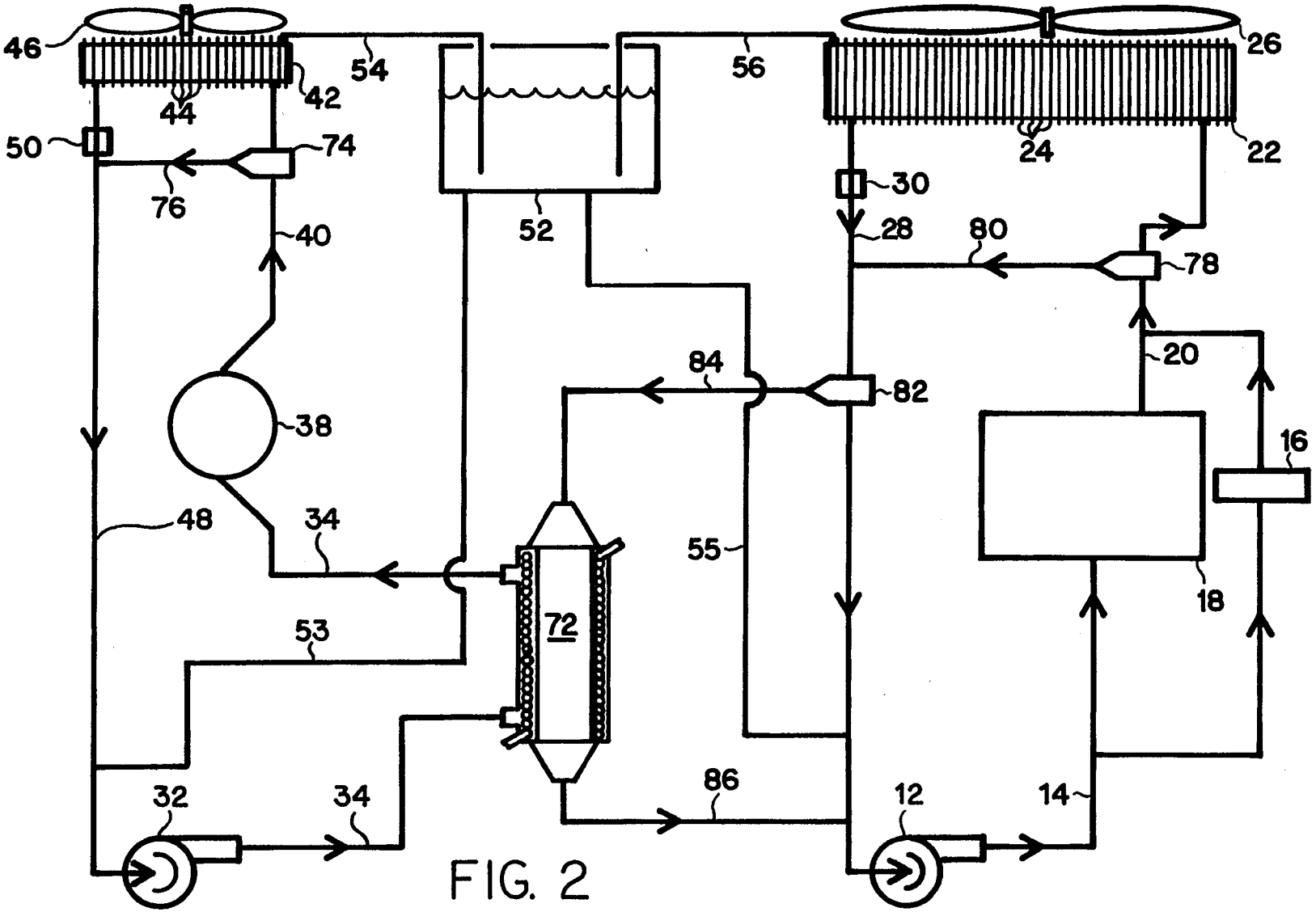
FIG. 2 is a second embodiment schematic representation showing an aftercooler cooling loop, an engine jacket water cooling loop and a vaporizer for continuous heat exchange with either or both aftercooler coolant and engine jacket water.

A second embodiment utilizing a combined vaporizer and engine to aftercooler heat exchanger 72 is shown in schematic format in FIG. 2. The combined vaporizer and engine to aftercooler heat exchanger 72 is shown in more detail in FIG. 4. In this embodiment, both the engine jacket water coolant and aftercooler coolant loops remain basically the same as in the first embodiment except for the addition of aftercooler radiator bypass regulator 74 and the associated aftercooler bypass line 76 in the aftercooler loop, and engine radiator bypass regulator 78 and its associated radiator bypass line 80, which are both used to eliminate unwanted coolant heat loss during low temperature operating conditions.

Figure 4:
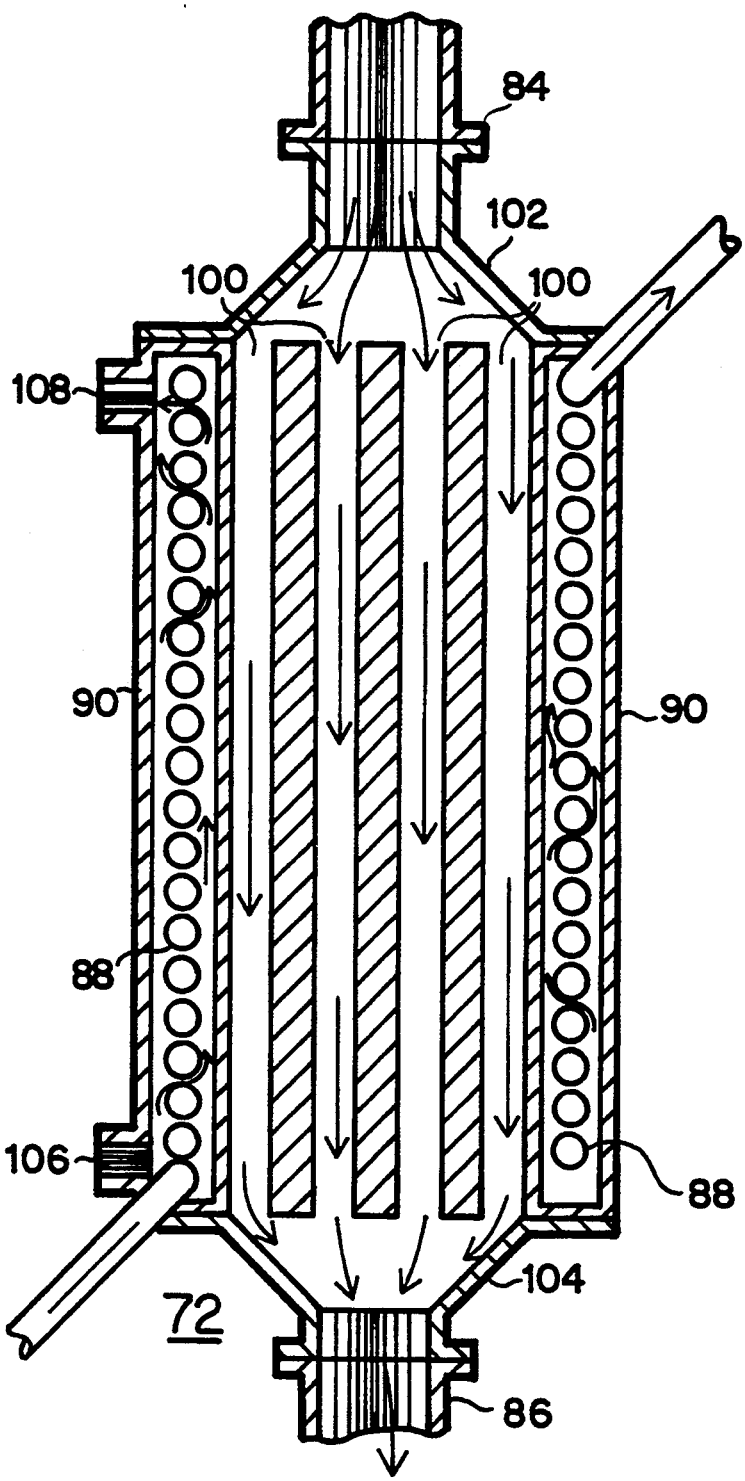
FIG. 4 is a representational sectional side view of the combination vaporizer shown in FIGS. 2 and 3.

In this embodiment, aftercooler coolant being pumped into discharge line 34 always flows through combined vaporizer and engine to aftercooler heat exchanger 72. As shown in FIG. 4, combined vaporizer and engine to aftercooler heat exchanger 72 provides a coiled vaporizer tube 88 which is disposed within aftercooler coolant jacket 90 which receives aftercooler coolant through aftercooler coolant inlet 106, from where it flows up over vaporizer coil 88 and out through aftercooler coolant outlet 108. Engine jacket water, flows through supply line 84 into inlet manifold 102 and from there into engine jacket water heat exchanger tubes 100 and out through the discharge manifold 104 into return line 86.

As previously stated, aftercooler coolant is always flowing through aftercooler coolant jacket 90 during engine operation. Engine jacket water coolant flow through engine jacket water neat exchanger tubes 100 is regulated by means of regulator 82. The principles of operation for this second embodiment are the same as for the first embodiment as shown and described herein.

Figure 3:
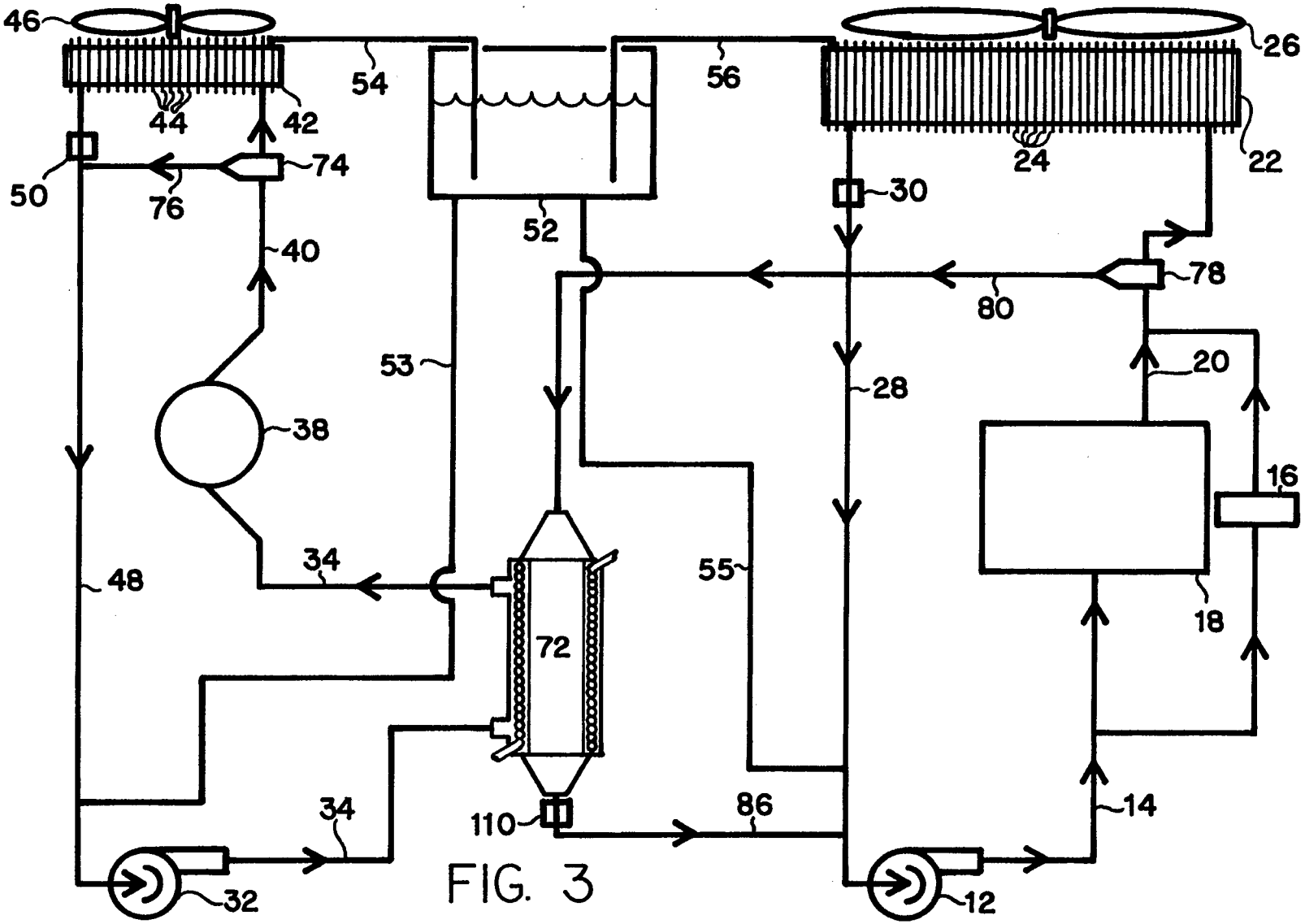
FIG. 3 is a third embodiment schematic representation showing an after cooler cooling loop, an engine jacket water cooling loop and a vaporizer for continuous heat exchange with either or both the after cooler coolant and engine jacket water.

FIG. 3 shows yet a third embodiment which eliminates regulator 82, of the second embodiment, and instead provides for a relatively simple thermostatic valve 110 which is closed at the design point of the aftercooler coolant stream, 90° F., and open, or partially open, at any temperature below that. When thermostatic valve 110 is closed, no engine jacket water flows through combined vaporizer and engine to aftercooler heat exchanger 72. When the temperature within combined vaporizer and engine to after cooler heat exchanger 72 falls below the set point, thermostatic valve 110 is operable to regulate or meter the flow of engine jacket water through it in order to keep aftercooler coolant and vaporized LNG at the set point temperature.

Thus, in all three embodiments, the temperature of the vaporized LNG will closely track with the temperature of the aftercooler coolant. And, since the aftercooler coolant temperature itself tracks with the temperature of the cool compressed combustion air passing out of aftercooler 38, a close correlation and tracking of temperatures between the combustion air being delivered to engine 18 and the vaporized LNG fuel is maintained.

It has been found in practice that during engine start up, and idling at either very low or very high ambient air temperatures, a carbureted natural gas engine will run best if the temperature of the vaporized LNG is maintained within 25° F. of the temperature of the charged combustion air. LNG vaporizing schemes that rely solely on engine jacket water, unless of complex design, allow wide variations in temperature between the vaporized fuel and the combustion air, particularly at engine idle or low power settings during either extreme cold or hot air ambient conditions. These cause the volumetric air to fuel metering system of the carburetor to become unbalanced so as to exceed the operational limits of the engine. In such circumstances, an idling or lightly loaded engine will run erratically and can stall.

There are some other additional advantages to the preferred embodiments described herein. First, by limiting the variations in the volumetric air to fuel ratio to more closely match the a desired air to fuel mass ratio, an air to fuel ratio that is slightly leaner than the stoichiometric ratio can be maintained. This air to fuel ratio enhances stability of engine operation, particularly at idle. Also limiting variations can be a significant aid to designers and operators in maintaining specific pollutant emission levels as may be required by various governmental agencies.

While there is shown and described the present preferred embodiment of the invention, it is to be distinctly understood that this invention is not limited thereto but may be variously embodied to practice within the scope of the following claims.

I claim:

1. In an engine assembly having a vaporized natural gas fueled, coolant cooled and carbureted engine, charging means for compressing inducted combustion air, an aftercooler for regulating the temperature of compressed combustion air, engine coolant radiator means, an engine coolant loop for the flow of engine coolant through the engine and the engine coolant radiator, means for inducing flow of engine coolant through the engine coolant loop, an aftercooler coolant radiator, an aftercooler coolant loop for the flow of aftercooler coolant through the aftercooler and the aftercooler coolant radiator, and means for inducing flow of aftercooler coolant through the aftercooler coolant loop, an apparatus for regulating the temperature of vaporized natural gas fuel which comprises:

a vaporizer positioned in heat exchange relationship with the aftercooler coolant loop for transfer of sufficient heat from the aftercooler coolant to liquified natural gas to vaporize said liquified natural gas and to raise its temperature to a point within a predetermined temperature bandwidth, and to change said temperature in linear relationship with changes in the temperature of the compressed combustion air.

2. The apparatus of claim 1 which further comprises:

an engine to aftercooler heat exchanger for the transfer of heat from engine coolant to aftercooler coolant;

means for diverting a flow of engine coolant from the engine coolant loop to and through the engine to aftercooler heat exchanger;

means for sensing aftercoolant temperature; and means for diverting the flow of a aftercooler coolant from the aftercooler radiator to and through said engine to aftercooler heat exchanger when the temperature of the aftercooler coolant is below a predetermined setpoint temperature.

3. The apparatus of claim 2 which further comprises:

means for sensing engine coolant temperature; and control means for diverting a flow of engine coolant from the engine coolant loop to and through said engine to aftercooler heat exchanger only when the engine coolant temperature is colder than that required for proper engine operation.

4. In an engine assembly having a vaporized natural gas fueled, coolant cooled and carbureted engine, charging means for compressing inducted combustion air, an aftercooler for regulating the temperature of compressed combustion air, engine coolant radiator means, an engine coolant loop for the flow of engine coolant through the engine and the engine coolant radiator, means for inducing flow of engine coolant through the engine coolant loop, an aftercooler coolant radiator, an aftercooler coolant loop for the flow of aftercooler coolant through the aftercooler and the aftercooler coolant radiator, and means for inducing flow of aftercooler coolant through the aftercooler coolant loop, an apparatus for regulating the temperature of vaporized natural gas fuel which comprises:

heat exchanger means for receiving liquified natural gas for indirect heat exchange with aftercooler coolant to produce vaporized gaseous fuel and to raise its temperature to a point within a predetermined temperature bandwidth and to change said temperature in linear relationship with changes in the temperature of the compressed combustion air.

5. The apparatus of claim 4 wherein said heat exchanger means further comprises:

means for receiving warmed engine coolant for indirect heat exchange with the liquified fuel to produce vaporized gaseous fuel;

means for sensing aftercooler coolant temperature; and means for diverting a flow of engine coolant into said heat exchanger when the temperature of said aftercoolant is below a predetermined temperature.

6. The apparatus of claim 5 wherein said means for diverting a flow of engine coolant into said heat exchanger further comprises:

piping means operatively connecting the engine coolant loop to said heat exchanger; and a diversion regulator for diverting a flow of warm engine coolant from the engine coolant loop into said piping means.

7. The apparatus of claim 5 wherein said means for diverting a flow of engine coolant into said heat exchanger further comprises:

piping means operatively connecting the engine coolant loop to said heat exchanger for continuously diverting a flow of engine coolant from the engine coolant loop to and through said heat exchanger; and thermostatic valve means for regulating the flow of engine coolant through said heat exchanger operatively connected to said piping means.

* * * * *